US005729817A

United States Patent [19]

Raymond et al.

[11] Patent Number: 5,729,817

[45] Date of Patent: Mar. 17, 1998

[54] ACCENT PRINTER FOR CONTINUOUS WEB MATERIAL

[75] Inventors: Michael W. Raymond, Bolton; Damian P. Bianchi, Durham, both of Conn.

[73] Assignee: Accent Color Sciences, Inc., East Hartford, Conn.

[21] Appl. No.: 732,936

[22] Filed: Oct. 17, 1996

[51] Int. Cl.[6] ..... G03G 15/00; B41J 13/08

[52] U.S. Cl. ..... 399/384; 101/178; 347/154; 400/635

[58] Field of Search ..... 347/154, 139, 347/153, 262, 264; 399/384; 101/178; 400/635

[56] References Cited

U.S. PATENT DOCUMENTS 5,133,616 7/1992 Oyaide et al. ..... 400/635

5,499,093 3/1996 Aerens et al. ..... 399/384 X

*Primary Examiner*—Arthur T. Grimley

*Assistant Examiner*—Sophia S. Chen

*Attorney, Agent, or Firm*—Alix, Yale & Ristas, LLP

[57] ABSTRACT

An accent color printer for printing on a continuous web of material has spaced apart drums, and a flexible continuous belt positioned around the drums. The belt defines a transport path having an arcuate portion at one of the drums. A platen cooperates with the belt to define a curvilinear print region for said transport path. An input module positions a continuous web onto the moving belt. Print heads positioned adjacent the belt print accent colors onto the web at the print region. An outfeed module removes the web from the belt at arcuate portion of the transport path and tensions the removed web whereby the web forms a capstan wrap with the belt at the arcuate portion of the transport path. The capstan wrap results in the tension in the web at the printer region being increased from the tension in the web removed from the belt.

8 Claims, 3 Drawing Sheets

ACCENT PRINTER FOR CONTINUOUS WEB MATERIAL

BACKGROUND OF THE INVENTION

1. Field of the Invention

The present invention relates to the high speed processing of printed material and, particularly, to the high speed transport of a continuous web of print receiving material. Specifically, this invention is directed to a high speed transport for a continuous web of paper and especially to a transport which includes, along the transport path, a curvilinear print zone wherein accent color printing may be added to pre-printed text. Accordingly, the general objects of the present invention are to provide new and improved methods and apparatus of such character.

2. Description of the Prior Art

Conventional high-speed electrographic or xerographic printers have typically been capable of printing in only a single color. There was, accordingly, a long felt need to provide color highlights or accents on an electrographic or xerographic produced document. This long felt need has recently been satisfied by the accent color printers disclosed in co-pending applications Ser. No. 08/334,192, filed on Nov. 4, 1994 and Ser. No. 08/522,798, filed on Nov. 3, 1995, which are assigned to the assignee of the present invention. These co-pending applications are hereby incorporated herein by reference.

At least two substantial difficulties have been encountered in attempting to provide the addition of colored accents to a pre-printed document. First is the ability of the accent color printer to operate at substantially the same throughput rate as the host printer. The second difficulty is in obtaining and maintaining precise alignment of the pre-printed documents in order that the accent color will be printed at the correct location on the document. Even small variations of positioning of the accent colors on the pre-printed document result in unacceptable print qualities.

Many high-speed host printers print onto a continuous sheet or web of material. The web is fed off a roll and into the host printer, wherein documents are generally printed adjacent one another on the continuous web. Conventional webs have employed lines of openings, i.e., tractor feed holes, along each edge of the web. Tractor feed mechanisms having toothed wheels or sprockets engage the tractor feed holes to align the web material within the printer and prevent lateral motion of the web relative to the feed direction of the web. The tractor feed mechanisms are further employed for driving the web through the printer.

The necessity of providing tractor feed holes increases the operational expense of the printer. Web manufacturing costs are increased by requiring the formation of the tractor feed holes, and further by also requiring the formation of perforations to allow simplified removal of the edges of the web containing the tractor feed holes. The additional manufacturing steps to add the tractor feed holes and perforations, the additional processing equipment to remove the web edges containing the tractor feed holes after printing, and the waste and disposal of material associated with the edge strip having the tractor feed holes, generally increase the operational expenses of printers employing web feed materials.

The tractor feed holes can, however, serve an important aligning function during the addition of accent color to the documents of the web. In particular, the tractor feed holes insure that the accent color will be precisely positioned to result in a high quality printed product. In prior art transports designed for use with web-like printing material, without the use of a tractor mechanism which engages the tractor feed holes, the web can exhibit sufficient lateral movement or wandering to degrade print quality, resulting in misaligned printing, or printing that fails to overlap correctly.

SUMMARY OF THE INVENTION

Briefly stated, the invention overcomes the above-described and other deficiencies and disadvantages of the prior art by providing a high speed accent color printer comprising a conveyor assembly having first and second end drums, and a flexible continuous conveyor belt positioned around and tensioned on the end drums. The conveyor belt defines a transport path having a curvilinear print region and an arcuate end portion at the second end drum, the radius of the arcuate end portion being much smaller than that of the print region.

In a preferred embodiment of the invention, an input module receives a continuous web from a host printer and accurately positions the web onto the conveyor belt. The input module applies a preset tension to the continuous web. The web is transported by the conveyor belt past multiple print heads.

The web is moved by the conveyor belt, after printing, to the arcuate end portion of the transport path. An output module removes the web from the arcuate portion of the transport path. The output module generates a preset tension in the web. The combination of the web laying against the moving conveyor belt along the arcuate portion of the transport path and the tension in the web generated by the output module forms what is defined as a capstan wrap of the web with the conveyor belt at the arcuate end portion of the transport path. The capstan wrap of the web increases the tension in the portion of the web traversing the print region of the transport path for improved web tracking.

The tension in the web created by the output module is multiplied by the capstan wrap to result in a greater tension in the web in the print region. This increased web tension results in a substantial holding force of the web material to the conveyor belt. The increased holding force substantially eliminates lateral motion or wandering of the web relative to the conveyor belt. Therefore, highly accurate printing of accent colors on pre-printed documents of the high speed moving web is achieved. Furthermore, the holding force resulting from the capstan wrap permits the web to be driven by the conveyor belt at an increased velocity for an increased throughput rate of the accent color printer. Driving the web at the increased tension without the use of the conveyor belt would result in destruction of the web.

The substantial elimination of relative lateral motion between the belt and the web eliminates the requirement for tractor feed holes in the web. An accent color printer in accordance with the invention, therefore, is characterized by reduced operating costs by virtue of allowing the use of a less expensive web material. Furthermore, the use of a plain web, i.e., a web not requiring tractor feed holes, eliminates the waste of materials associated with removing and disposing of the portions of the web having the tractor feed holes. In addition, a printer in accordance with the invention has improved throughput rates and improved printing alignment even with webs having tractor feed holes for other purposes.

An object of the invention is to provide a printer having a conveyor system for moving a web of print receiving material that does not have tractor feed holes.

Another object of the invention is to transport a continuous web of paper or the like at a high linear velocity without lateral movement of the web relative to a conveying belt.

A further object of the invention is to provide an accent color printer having an improved throughput rate for web-like printing materials.

These and other objects of the invention will be apparent from review of the specification and drawings.

DESCRIPTION OF THE DRAWINGS

The present invention may be better understood, and its numerous objects and advantages will be more apparent to those skilled in the art, by reference to the accompanying drawings wherein like reference numerals refer to like elements in the revival figures and in which.

DETAILED DESCRIPTION OF THE PREFERRED EMBODIMENT

An accent color printer in accordance with the invention is generally designated by the numeral 10. The accent color printer 10 adds precisely positioned accent color highlights to documents which have previously been printed on a continuous web 12.

Figure 1:
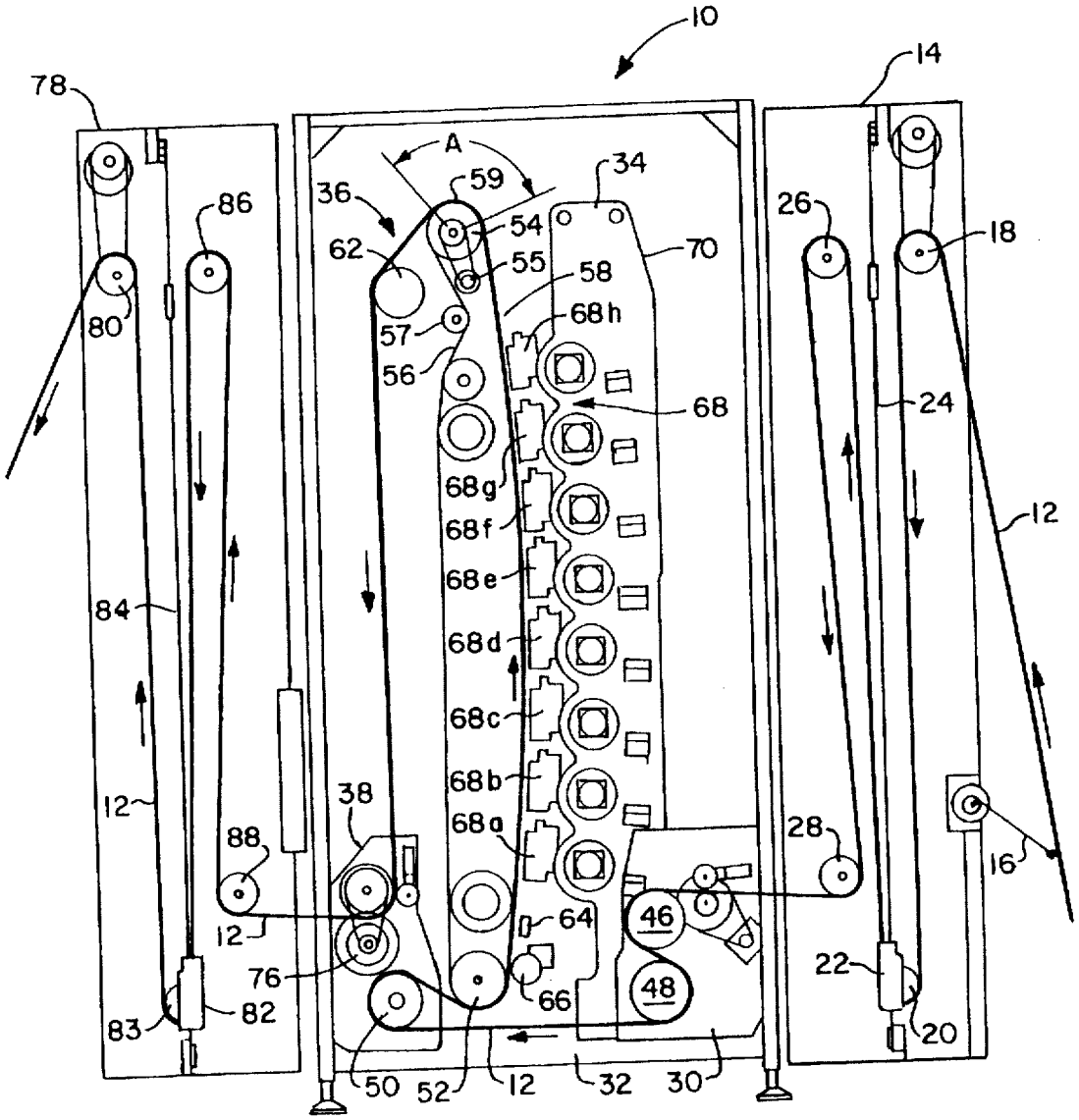
FIG. 1 is a schematic side elevation view, partially broken away and partially in phantom, of an accent color printer in accordance with the invention, the printer being depicted in conjunction with input and output buffers.

The web 12 is received from a host printer (not shown) and directed into an input buffer 14 associated with the accent color printer 10. (See FIG. 1 ) The input buffer 14 forms web 12 into a loop that can be varied in length to compensate for differences in throughput rates between the accent color printer 10 and the host printer. Input buffer 14 further compensates for on and off cycling of the accent color printer 10 and the host printer. The input buffer 14 has a bail mechanism 16 which engages web 12 to measure the slack in web 12 and generate a control signal commensurate therewith. A printer control mechanism (not shown) employs the signal provided by bail mechanism 16 to measure the difference in throughput rates between the accent color printer 10 and the host printer, and thereby adjust the throughput rate of the accent color printer 10 and the throughput rate of the host printer to be substantially the same.

In the input buffer 14, the web 12 passes over a driven roller 18 and around a roller 20 mounted to a vertically adjustable dancer or cart 22. The cart 22 moves on a vertically oriented track 24 whereby, when the cart 22 moves to the bottom portion of the input buffer 14, the loop of the web 12 is extended, and when the cart 22 moves to the top portion of the input buffer 14 on the track 24, the loop of the web 12 is reduced. The web 12, downstream of the variable length loop, passes over idler rollers 26, 28. Idler roller 28 directs the web 12 to an input module 30 of the accent color printer 10.

A chassis 32 of printer 10 supports input module 30. The chassis further supports a printer assembly 34, a vertically oriented conveyor assembly 36 and an output module 38. Printer assembly 34 prints accent color highlights onto the moving web 12 as it is supported by the conveyor assembly 36.

Figure 2:
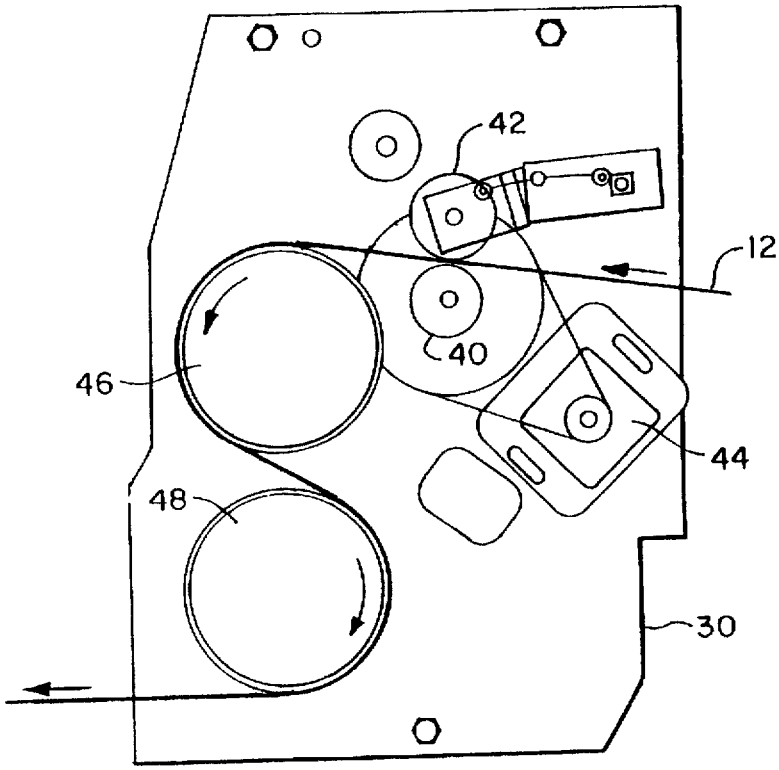
FIG. 2 is a partial, enlarged, detailed, side elevation view of a portion of the input module of the accent color printer of FIG. 1.
Figure 3:
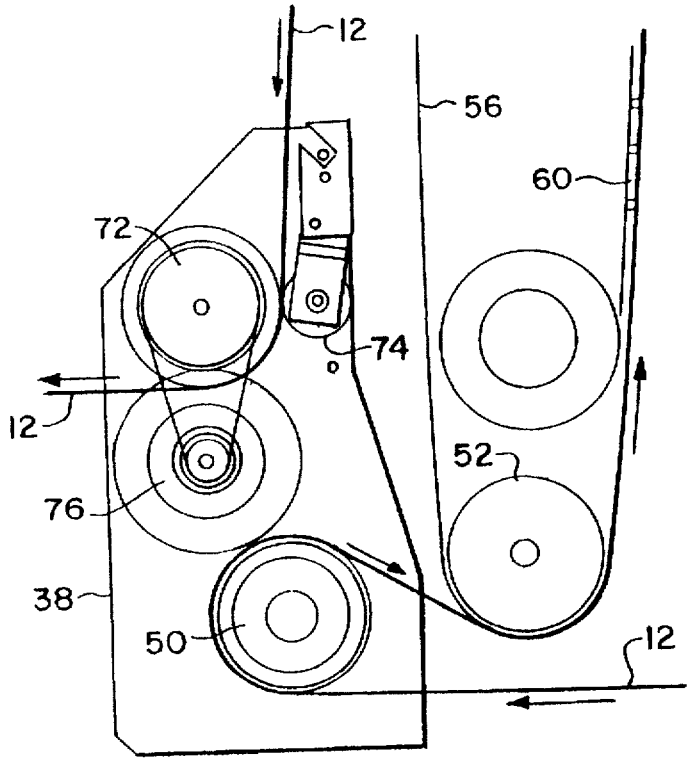
FIG. 3 is a partial, enlarged, detailed, side elevation view of the output module and lower portion of the conveyor of the accent color printer of FIG. 1.

Referring to FIG. 2, the web 12 is directed into the input module 30, and supported against a driven input roller 40, by a tensioned pinch roller 42. The driven input roller 40 is controlled by a direct current motor 44 arranged to drive roller 40, and thus web 12, in a direction opposite to the normal downstream travel direction of the web. The force applied to web 12, in the manner to be described below, overcomes the opposed force resulting from the action of motor 44, thereby resulting in the application of tension to the web 12 as it travels between the input module 30 and the conveyor assembly 36. Alternately, a drag producing mechanism, such as a hysteresis clutch, could be employed in place of the motor 44 to generate a predetermined amount of tension on the web 12. In one accent color printer, constructed in accordance with the invention, the operation of motor 44 results in a tension of 2–3 pounds on the web 12. The tensioned web 12 continues over a pair of heated rollers 46, 48 which raise the temperature of the web to an optimal temperature for printing as described below. The web 12 is drawn through the heated rollers 46, 48 to a heated positioning roller 50 that positions and directs the web onto the conveyor assembly 36. (See FIGS. 1 and 3)

The conveyor assembly 36 has a lower belt drum 52 and an upper belt drum 54. The upper belt drum 54 is driven via a drive belt by a motor 55. The upper and lower belt drums 52, 54 cause a perforated conveyor belt 56 to move over a curvilinear perforated platen 60. The conveyor belt 56 defines a transport path which includes a curvilinear printing region or station 58 at the platen 60. The transport path also includes an arcuate upper portion 59 at the upper drum 54. The upper and lower belt drums 52, 54 are tapered at each end to provide accurate wander-free tracking of conveyor belt 56. A tension drum 57 in rolling contact with the conveyor belt 56 is adjustable to place a relatively high tension on conveyor belt 56 to further improve tracking of the belt 56 and thereby reduce belt wandering, i.e., movement of the belt lateral to the direction of the transport path. In one printer built in accordance with the invention, a tension of 50 pounds on the conveyor belt was found to give a high degree of belt tracking accuracy.

The web 12 is directed onto the lower portion of the conveyor assembly 36 and held in position, in part, by a vacuum force. The vacuum force results from the perforated conveyor belt 56 sliding over the perforated platen 60 as the belt 56 is driven around drums 52, 54. Fans or blowers (not shown) evacuate air from the interior of the conveyor assembly 36 behind platen 60 to draw air through registered perforations of the conveyor belt 56 and platen 60 and thereby generate a vacuum force to support the web 12 on belt 56. The curve of the platen 60 serves to substantially eliminate slack in the conveyor belt 56 thereby eliminating the lateral belt movement which is characteristic of a conveyor belt driven over a flat surface. In one printer constructed in accordance with the invention, a platen having generally a 16 foot radius curve was found to insure the requisite wander-free tracking of conveyor belt 56.

Figure 4:
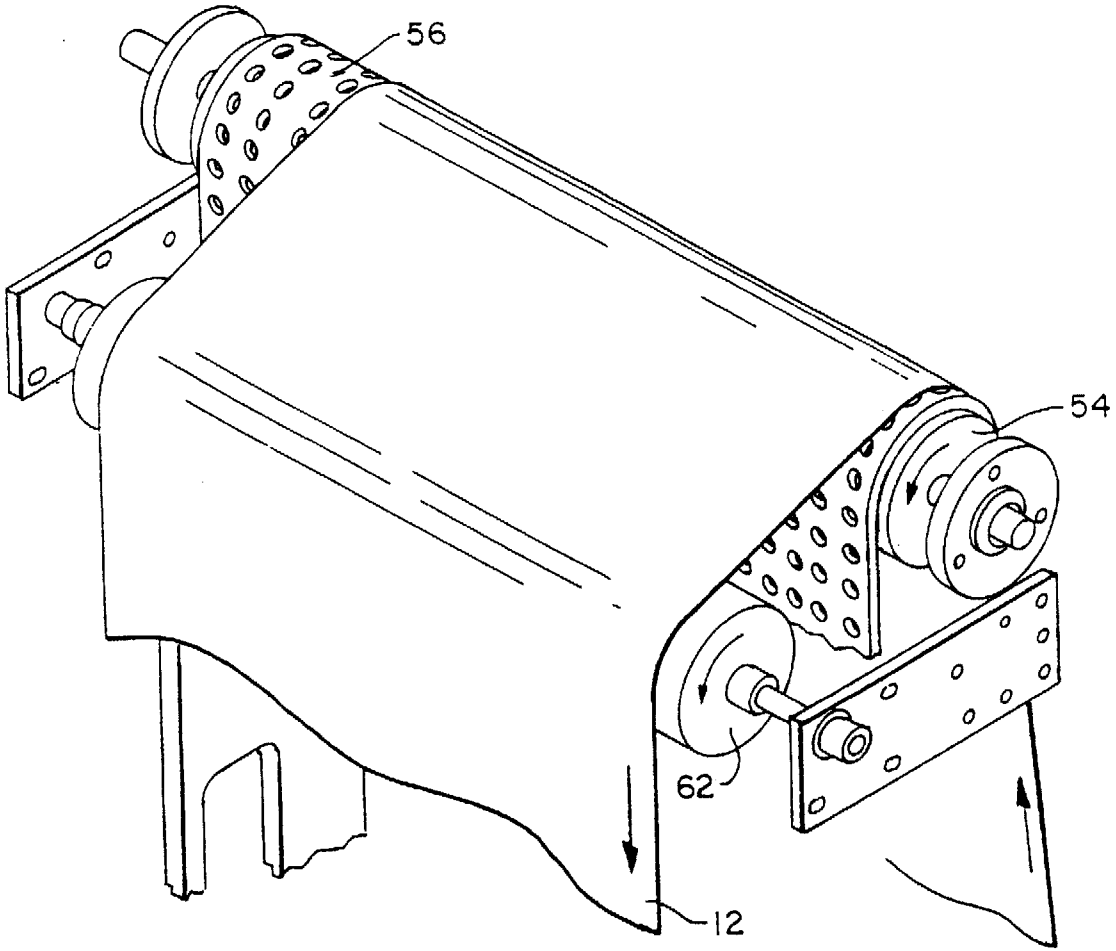
FIG. 4 is an isometric view of the upper portion of the conveyor of FIG. 1.

Web 12 is directed through the curvilinear print region 58 to the upper belt drum 54 and is removed from conveyor belt 56 by an adjustable position idler roller 62 located adjacent upper belt drum 54. (See FIGS. 1 and 4) The web 12 defines a capstan wrap with the conveyor belt 56 as it travels over the upper belt drum 54 at the relatively small diameter arcuate upper portion 59 of the transport path. In one accent color printer constructed in accordance with the invention, the upper belt drum 54 has a diameter of 4 inches to form the capstan wrap. The capstan wrap of web 12 at the upper belt drum 54 is the result of the output module 38 placing a preset tension on web 12 in the manner to be described below. The tension applied to web 12 by output module 38 is multiplied due to the capstan wrap of the web 12 at the arcuate portion 59 of the transport path to result in an increased tension in web 12 in the print region 58 of the transport path. In other words, the tension on the web 12 in the print region 58 is greater than the preset tension on the web 12 as generated by the output module 38. The web 12 undergoes a change in tension as it is driven the conveyor belt 56 through the arcuate portion 59 of the transport path.

Theoretically, for a capstan wrap, the relation of tensions on the web 12 on either side of the arcuate portion 59 of the transport path can be described as $T_1/T_2=e^{fA}$, where $T_1$ is the tension on the web 12 on the printer side. $T_2$ is the tension on the web 12 as a result of the outfeed module 38, f is the coefficient of friction between the web 12 and the conveyor belt 56, and A is the angle wrap (in radians) of the web 12 on the arcuate portion 59 of the transport path at the upper belt roller 54. (See FIG. 1)

In one accent color printer, built in accordance with the invention, the outfeed module 38 applied a tension of approximately 5–6 pounds to the web 12 at the outfeed side of the conveyor assembly 36, and the web 12 experienced a tension of approximately 15 pounds as it traveled over the platen in the print region 58. The high tension on the web 12 in the print region allows consistent and accurate tracking at web speeds of forty-four (44) in/sec. The positioning of the idler roller 62 adjusts the angle A of the capstan wrap by the web 12 and, therefore, repositioning of the idler roller 62 can adjust the final tension in the web 12 in the print region 58. (See FIGS. 1 and 4) Generally, the angle A is preferably in the range of 110°–120° for a paper web 12 and a polyester conveyor belt 56, but may vary depending on web and conveyor belt materials.

It has been found that approximately 15 pounds of tension results in the elimination of lateral motion or wandering of the web 12 on the conveyor belt 56. This, in turn, allows for improved printing accuracy onto pre-printed documents of the web 12. Over-tensioning of the web 12 in the print region 58 can, of course, lead to actual destruction of the web 12. It should be recognized that, as the web 12 travels over the platen 60 in print region 58, the web travels a slightly greater radius than the conveyor belt 56. Therefore, the web 12 actually moves at a higher linear velocity and will creep or slide in the direction of travel of the web 12 at a linear velocity faster than the linear velocity of the underlying conveyor belt 56. The amount of forward slip of the web 12 will be generally related to the thickness of the web material. Thicker webs will have a slightly increased radius in the print region 58 relative to the conveyor belt 56, and will therefore exhibit a relatively higher degree of forward slip relative to thinner webs. However, this linear motion of the web 12 relative to the conveyor belt 56 does not result in detrimental lateral motion or wandering of the web 12. The web 12 will exhibit almost no forward slip at the arcuate portion 59 of the transport path due to the capstan wrap locking the web 12 to the conveyor belt 56.

The print assembly 34 has a print frame 70 oriented generally vertically and parallel to the conveyor assembly 36. The print frame 70 supports a plurality of wax based ink jet printer heads 68*a–h* adjacent to surface of the web 12 in the print region 58. The print heads 68*a–h* may, for example, print sequentially onto each document on the web 12 as the documents move through the print region 58. The heated rollers 46, 48, 50 increase the temperature of the web 12 for improved printing by print heads 68 employing the preferred wax based inks.

A top of form sensor 64 senses top of form marks on the web 12 printed by the host printer to indicate the beginning of each document on the web 12. An encoder wheel 66 rides on the surface of the web 12 and determines the actual linear speed of each document of the web 12. A printer control system (not shown) employs the signals from the top of form sensor 64 and the encoder wheel 66 to determine the exact position of each document and thereby control the print heads 68*a–h* to print at the correct sequential times to place accent colors onto the pre-printed documents of the web 12.

The web 12 is fed downward from the idler roller 62 to the output module 38. A driven roller 72 and a pinch roller 74 capture the web 12 therebetween. The driven roller 72 is preferably driven by a torque motor 76. The torque motor 76 drives roller 72, and thus the web 12, at a constant torque and is capable of stalling as the conveyor assembly 36 cycles on and off to match the output rate of the host printer. The torque motor 76 generates the preset tension on the web 12 which produces the capstan wrap of web 12 at the arcuate portion 59 of the transport path.

From the output module 38, the web 12 is directed to an output buffer 78 which forms a continuous variable loop of web material to compensate for differentials in the throughput rates of the printer 10 and any post printing possessors such as cutters, stackers, etc. Similar to the input buffer 14, the output buffer has a driven roller 80 and a vertically movable cart 82 supporting a roller 83 on a track 84. The cart 82 moves the roller 83 vertically to extend or retract the loop of web material 12 in order to adjust for the variable throughput rates of the components of a complete printer assembly. Additional output buffer rollers 86, 88 maintain the output loop of the web 12.

It should be recognized that the structure and operation of the accent color printer 10 can be readily employed for host printers or other forms of primary printers that use a web as a printing medium.

In a further embodiment of an accent color printer 10 in accordance with the invention, the input and output buffers 14, 78 compensate for reversing of the direction of travel of the conveyor assembly 36. In order to provide for complete accent color printing of all the documents on a particular portion of the web 12, the last document in a series of documents on a portion of the web 12 must travel past the last or uppermost print head 68*h* of the printer assembly 34. However, in order to print on a subsequent document, that subsequent document on the web 12 must be positioned in front of the first or lowest print head 68*a*. This problem typically occurs because the host printer will stop printing after each series of different documents. Therefore, in order to avoid waste of the material of the web 12 by having large gaps between two series of different documents, the last document of one series of documents must travel past the last print head 68*h* before the first document of the next series of documents travels past the first print head 68*a*. Therefore, an accent color printer 10 in accordance with the invention can be driven in the reverse direction. The conveyor assembly 36 drives, at reduced speed, the web 12 in a generally downward or reverse direction on the conveyor belt 56 after the printing by the last print head 68*h* of the last document of an initial series of documents. This reversing of the conveyor assembly 36 resets the first document in a subsequent series of documents to be printed by the lowest print head 68*a*. In order to allow reversing of the continuous web 12, the input and output buffers 14, 78 can expand or contract the continuous loops of web material 12 positioned therein. For example, as the last document of an initial series of documents is about to be printed by the print heads 68*a–h*, the cart 22 of the input buffer 14 will then generally rise vertically, therefore shortening the loop of the web 12 in the input buffer 14. When the last document of the initial series of documents has received printing from the print head **68*h*, the conveyor assembly 36 reverses the direction of the rotation of the conveyor belt 56. The cart 22 of the input buffer 14 will generally move downward, taking up the slack of the web 12 as it is reversed in direction of travel, and the cart 82 of the output buffer 78 will rise to provide sufficient slack in the output portion of the web 12 to allow reversing of the conveyor assembly 36. The reverse motion of the web 12 continues until the first document of the subsequent series of documents is set to be printed by the first print head 68*a***.

While preferred embodiments of the present invention has been illustrated and described in detail, it should be readily appreciated that many modifications and changes thereto are within the ability of those of ordinary skill in the art. Therefore, the appended claims are intended to cover any and all of such modifications which fall within the true spirit and scope of the invention.

We claim:

1. A printer for printing on a continuous web of material comprising:

means for providing a continuous web of printable material;

a pair of spatially displaced drums;

a flexible continuous belt extending around said drums, said belt and drums cooperating to form a conveyor which defines a transport path for said web, said transport path having an arcuate portion at one of said drums;

means cooperating with said belt to define a curvilinear print region intermediate said drums;

printer means positioned adjacent said belt in said print region for printing on said web;

infeed means for directing said web from said providing means onto said transport path;

outfeed means for receiving said web from said transport path and tensioning said web with a preset tension on said arcuate portion, wherein said web forms a capstan wrap with said belt at said arcuate portion, whereby a tension is generated in said web at the print region greater than said preset tension of said outfeed means.

2. A printer of claim 1 wherein said printer surface has a radius of generally 16 feet.

3. The printer of claim 1 wherein said web forms a capstan wrap of approximately 110° with said conveyor belt.

4. The printer of claim 1 wherein said infeed means comprises a driven roller and a pinch roller, said web fed between said driven roller and said pinch roller, and said driven roller placing tension on said web.

5. The printer of claim 1 wherein said outfeed means comprises a driven roller and a pinch roller, said web fed between said driven roller and said pinch roller.

6. The printer of claim 1 wherein the one of said drums at said arcuate portion has a diameter of generally 4 inches.

7. A method for transporting and printing on a continuous web comprising the steps:

placing the web on a conveyor belt;

moving the belt to define a transport path having a curvilinear print region and an arcuate portion having a radius less than said print region;

printing on said web at said print region;

removing said web from said belt at said arcuate portion of said transport path;

placing a tension on said web removed from said belt to define a capstan wrap of said web with said belt at said arcuate portion of said transport path wherein said tension of said web at said print region is greater than said tension in said removed web.

8. The method of claim 7 wherein said web comprises pre-printed documents and said printing step comprises printing an accent color on said documents.

* * * * *